US009090841B2

(12) United States Patent
McCallien et al.

(10) Patent No.: US 9,090,841 B2
(45) Date of Patent: Jul. 28, 2015

(54) TRACERS AND METHOD OF MARKING HYDROCARBON LIQUIDS

(71) Applicants: Duncan William John McCallien, Durham (GB); Ian Stuart Edworthy, Tyne and Wear (GB); Vincent Brian Croud, South Yorkshire (GB)

(72) Inventors: Duncan William John McCallien, Durham (GB); Ian Stuart Edworthy, Tyne and Wear (GB); Vincent Brian Croud, South Yorkshire (GB)

(73) Assignee: JOHNSON MATTHEY PUBLIC LIMITED COMPANY, London (GB)

( * ) Notice: Subject to any disclaimer, the term of this patent is extended or adjusted under 35 U.S.C. 154(b) by 0 days.

(21) Appl. No.: 14/362,710

(22) PCT Filed: Dec. 4, 2012

(86) PCT No.: PCT/GB2012/053001
§ 371 (c)(1),
(2) Date: Jun. 4, 2014

(87) PCT Pub. No.: WO2013/083966
PCT Pub. Date: Jun. 13, 2013

(65) Prior Publication Data

US 2014/0331548 A1 Nov. 13, 2014

(30) Foreign Application Priority Data

Dec. 6, 2011 (GB) ..... 1120924.4

(51) Int. Cl.
*C10L 1/00* (2006.01)
*C10L 1/20* (2006.01)
*C10L 1/232* (2006.01)
*C10L 1/30* (2006.01)

(52) U.S. Cl.
CPC ..... *C10L 1/003* (2013.01); *C10L 1/303* (2013.01); *C10L 2230/16* (2013.01); *C10L 2270/023* (2013.01); *C10L 2270/026* (2013.01)

(58) Field of Classification Search
CPC ..... C10L 1/003; C10L 1/303; C10L 2230/16; C10L 2270/023; C10L 2270/036
See application file for complete search history.

(56) References Cited

U.S. PATENT DOCUMENTS 8,476,461 B2 * 7/2013 Ulrich et al. ..... 548/405
2004/0203159 A1 * 10/2004 Zander et al. ..... 436/3
2011/0069307 A1 * 3/2011 Forshee et al. ..... 356/300

FOREIGN PATENT DOCUMENTS

JP 2000019738 A 1/2001
WO WO 2010089587 A2 * 8/2010

OTHER PUBLICATIONS

STIC Structure Search Feb. 2015.*
Great Britain Search Report dated Apr. 2, 2012, in corresponding British Priority Appn. No. 1120924.4.
International Search Report dated Jun. 20, 2013 in corresponding PCT application.
Raymond Ziessel et al: "Elaborating Boron Dipyrromethene Dyes with Conjugated Polyaromatic Frameworks", Synlett, Aug. 30, 2010, pp. 2304-2310, XP055066168.

* cited by examiner

*Primary Examiner* — Pamela H Weiss
(74) *Attorney, Agent, or Firm* — Young & Thompson

(57) ABSTRACT

Method of marking a hydrocarbon liquid includes adding to the liquid a tracer compound of Formula I:

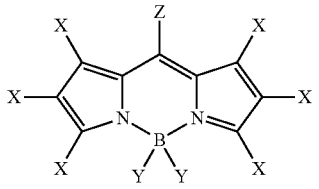

wherein, each X is independently hydrogen, bromine, fluorine, a halogenated alkyl group, a linear, branched or cyclic C1-C20 alkyl group, or a phenyl group substituted with one or more halogen atoms, an alkyl group or a halogenated alkyl group; each Y is independently bromine, fluorine, a halogenated alkyl group, a branched or cyclic C1-C9 alkyl group, or a phenyl group substituted with at least one alkyl and/or a halogenated alkyl group; Z is a phenyl group substituted with one or more halogen atoms, an aliphatic or halogenated aliphatic group, a halogenated alkyl group or a linear, branched or cyclic C1-C20 alkyl group, provided that when each Y is a fluorine atom, Z is not a linear or branched C1-C20 alkyl group.

23 Claims, No Drawings

TRACERS AND METHOD OF MARKING HYDROCARBON LIQUIDS

The present invention concerns marking hydrocarbon liquids with tracer materials, in particular hydrocarbons which are taxable or liable to be subject to tampering or substitution such as gasoline and diesel fuels for example.

It is well known to add tracers to hydrocarbon liquids. A typical application is the tagging of hydrocarbon fuels in order to identify the liquid at a subsequent point in the supply chain. This may be done for operational reasons, e.g. to assist in distinguishing one grade of fuel from another, or for other reasons, in particular to ensure fuel quality, deter and detect adulteration and to provide a means to check that the correct tax has been paid. Apart from fuels, other products, such as vegetable oils may be marked to identify the product produced at a particular source, or certified to a particular standard.

One problem which is known to exist with the marking of fuel liquids in particular, is the potential for the tracer to be removed, by evaporation from the fuel, by degradation of the tracer through ageing or exposure to environmental conditions such as heat, sunlight or air or alternatively by deliberate removal of the tracer for unlawful purposes such as for avoidance of tax. Methods for deliberate removal of tracers include adsorption of the tracer onto common adsorbent materials such as charcoal or clays, exposure to radiation, such as ultraviolet light, oxidation etc. A useful fuel tracer therefore needs to be resistant to removal by these common methods and also to more sophisticated treatments such as treatment with acids and/or bases. It is an object of the invention to provide a method of marking hydrocarbon liquids which is more resistant to removal of the tracer than known methods.

In addition to being difficult to remove from the intended medium, tracer molecules should ideally possess a property which is different from that of the medium and which allows for their ready identification. Molecules exhibiting a characteristic fluorescent response that is at a different wavelength from that of the bulk medium are particularly suited for use as tracer molecules. Fluorescence is a useful property for the tracer molecule to possess as not only can it can be detected with hand portable instrumentation but it usually allows for parts per million, or lower, levels of tracer molecules.

According to the invention we provide a method of marking a hydrocarbon liquid comprising the step of adding to said liquid, as a tracer compound, a compound of Formula I:

Formula I

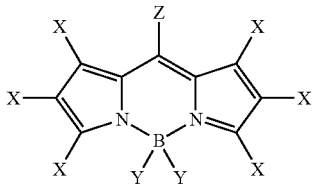

wherein each X is independently selected from the group consisting of a bromine atom, a fluorine atom, a partially or fully halogenated alkyl group, a linear, branched or cyclic $C_1$-$C_{20}$ alkyl group and a phenyl group substituted with one or more halogen atoms, an alkyl group or a halogenated alkyl group;

each Y is independently selected from the group consisting of a bromine atom, a fluorine atom, a partially or fully halogenated alkyl group, a branched or cyclic $C_1$-$C_9$ alkyl group and a phenyl group substituted with at least one alkyl group and/or a halogenated alkyl group; and Z is selected from the group consisting of (i) a phenyl group substituted with one or more halogen atoms, an aliphatic group or a halogenated aliphatic group, (ii) a partially or fully halogenated alkyl group or (iii) a linear, branched or cyclic $C_1$-$C_{20}$ alkyl group with the proviso that when each Y is a fluorine atom, Z is not a linear or branched $C_1$-$C_{20}$ alkyl group.

According to the invention, we also provide a liquid composition comprising a mixture of a hydrocarbon liquid and a tracer compound of Formula I.

Molecules based on Formula I are particularly suited as tracers, because, not only do they exhibit a fluorescence which is significantly different from that of most hydrocarbon fuels but they also exhibit excellent long term stability in a variety of fuel matrices.

The hydrocarbon liquid may be a pure compound such as hexane or octane or it may comprise a mixture of compounds such as a distillation fraction having a particular range of boiling points. The hydrocarbon liquid may be intended for use as a chemical, a solvent or a fuel. The invention is of particular use for marking liquid hydrocarbon fuels such as gasoline and diesel fuels. In one particular application a low-tax fuel such as an agricultural diesel may be marked in order to detect any subsequent sale and use for purposes such as road-vehicle fuel which would normally be taxed more highly. In such cases unlawful dilution or substitution of a more highly taxed fuel with the low-taxed fuel may be detected by analysis of the highly taxed fuel to determine whether the tracer is present. Therefore in these cases, it is highly beneficial to use a tracer compound in the low-taxed fuel which is not easily removed, or laundered, from the fuel to a level at which it can no longer be detected. We have found that compounds of Formula I are resistant to removal from hydrocarbon fuels by several known methods of fuel laundering.

Preferably, when any of X, Y or Z is a halogen or halogenated alkyl or phenyl group, the halogen atom is selected from bromine or fluorine and the halogenated alkyl group is a bromoalkyl or fluoroalkyl group. More preferably, the halogen atom is fluorine and the halogenated alkyl group is a fluoroalkyl group. The halogenated alkyl group(s) may be partially or fully halogenated, linear or branched, acyclic or cyclic aliphatic groups. Preferred halogenated alkyl groups include trifluoromethyl, 1,1-difluoroethyl, fluoroallyl, heptafluoropropyl, tridecafluorohexyl and heptadecafluorooctyl.

Alkyl group substituents may be straight chain or branched acyclic or cyclic aliphatic groups, preferably consisting of 4-12 carbon atoms. Branched or cyclic aliphatic groups are preferred. Preferred groups include tert-butyl, 1,1-dimethylpropyl, 2,2-dimethylpropyl (neo-pentyl), 1,1-dimethylbutyl, 1-ethyl-1-methylpropyl, 2,2-dimethylbutyl, 1,1,2-trimethylpropyl, 1,2,2-trimethylpropyl, 1-ethyl-2,2-dimethylpropyl, 1-methylethyl-2,2-dimethylpropyl, 1,1,3,3-tetramethylbutyl, cyclopentyl, cyclohexyl, 2-methylcyclohexyl, 3-methylcyclohexyl, 4-methylcyclohexyl, 2-ethylhexyl, 1-adamantyl, 2-adamantyl and decahydronaphthyl groups. Particularly preferred are substituents including quaternary substituted carbon atoms, such as tertiary butyl.

Each X is independently selected from the group consisting of a hydrogen atom, bromine atom, a fluorine atom, a partially or fully halogenated alkyl group, a linear, branched or cyclic $C_1$-$C_{20}$ alkyl group and a phenyl group substituted with one or more halogen atoms, an alkyl group or a halogenated alkyl group. X is most preferably hydrogen or a $C_1$-$C_6$ alkyl group, especially methyl, ethyl, or propyl.

Each Y is independently selected from the group consisting of a bromine atom, a fluorine atom, a partially or fully halogenated alkyl group, a branched or cyclic $C_1$-$C_9$ alkyl group, and a phenyl group substituted with at least one halogen, alkyl group and/or a halogenated alkyl group which is particularly preferably a perfluorinated alkyl group. Each Y is most preferably selected from a fluorine atom and substituted phenyl group, the substituents being selected from at least one of a fluorine atom and a fluorinated alkyl group.

Z is selected from (i) a phenyl group substituted with one or more halogen atoms, an alkyl group or a halogenated alkyl group, (ii) a partially or fully halogenated alkyl group or (iii) a linear, branched or cyclic $C_1$-$C_{20}$ alkyl group. When each Y is a fluorine atom, Z is not a linear or branched $C_1$-$C_{20}$ alkyl group. Z is preferably selected from (i) a phenyl group substituted with one or more halogen atoms, an alkyl group or a halogenated alkyl group, (ii) a partially or fully halogenated alkyl group or (iii) a cyclic $C_1$-$C_{20}$ alkyl group. Z is most preferably a phenyl group substituted with at least one alkyl group and/or a halogenated alkyl group which is particularly preferably a perfluorinated alkyl group.

The tracer compounds are derivatives of difluoroborondipyrromethene (IUPAC: 4,4-difluoro-4-bora-3a,4a-diaza-s-indacene), known as BODIPY™. In Formula 1, the Z substituent is at the 8 position of BODIPY, the boron atom is at position 4, the X substituents at positions 1,2,3 and 5,6 and 7. In BODIPY, each Y substituent is F.

Preferred compounds include:

(i) 8-(4-tert-butylphenyl)-1,3,5,7-tetramethyl-2,6-diethyl difluoroborondipyrromethene, (ii) 8-(3,5-bis(trifluoromethyl)phenyl)-1,3,5,7-tetramethyl-2,6-diethyl difluoroborondipyrromethene, (iii) 8-(3,5-bis(trifluoromethyl)phenyl)-1,3,5,7-tetramethyl-2,6-diethyl fluoro-(3,5-bis(trifluoromethyl))phenyl-borondipyrromethene (iv) 8-(3,5-bis(trifluoromethyl)phenyl)-1,3,5,7-tetramethyl-difluoroborondipyrromethene, (v) 1,3,5,7,8-pentamethyl-2,6-diethyl fluoro-perfluorophenyl-borondipyrromethene, (vi) 8-(t-butyl)-1,3,5,7-tetramethyl-2,6-diethyl fluoro-(3,5-bis(trifluoromethyl)phenyl)-borondipyrromethene, (vii) 8-(3,5-bis(trifluoromethyl)phenyl)-1,3,5,7-tetramethyl-2,6-diethyl bis(3,5-bis(trifluoromethyl)phenyl)-borondipyrromethene viii) 8-(perfluoropropyl)-1,3,5,7-tetramethyl-2,6-diethyl difluoroborondipyrromethene.

The tracer compound is added to the hydrocarbon liquid in such an amount as to provide a concentration of the tracer compound which is detectable by readily available laboratory methods capable of identifying the tracer compound in the liquid at the concentrations used. Suitable methods include, but are not limited to, (i) gas chromatography coupled with a suitable detector such as an electron capture detector or a mass spectrometer, (ii) fluorescence spectroscopy. Typical concentrations are within the range 1 μg/l to 1000 μg/l, the actual amount used depending on the detection method and limit of detection of the particular tracer compound used. The tracer compound may be present at a higher concentration than 1000 μg/l although when the product to be marked is a high-volume commodity such as a motor-fuel, economic considerations usually favour lower levels of tracer compound. The tracer compound may be supplied in the form of a concentrated dosing solution (or master-batch) of the tracer compound in a solvent. In this case the preferred solvent is a liquid which is similar to the liquid to be marked, although a different solvent, e.g. a hexane or mixed paraffins solvent may be used provided the presence of such a solvent can be tolerated in the hydrocarbon liquid to be marked. The concentrated dosing solution can be added to the hydrocarbon liquid to be marked so as to produce the required final concentration of the tracer compound by dilution. More than one tracer compound may be added to the liquid.

The selected tracer compound(s) is resistant to laundering by adsorption on activated charcoal or clay. In a preferred embodiment, at least 50% (more preferably at least 60%, especially at least 80%) of the tracer compound is retained in the hydrocarbon liquid after a 10 ml sample of the liquid containing the tracer compound has been shaken for 2 minutes with 0.5 g fresh activated charcoal. The test to be applied for resistance to laundering by adsorption on a solid adsorbent is described below.

Preferably at least 50% (more preferably at least 60%, especially at least 80%) of the tracer compound is retained in the hydrocarbon liquid after a 10 ml sample of the liquid containing the tracer compound has been shaken for 2 minutes with 0.5 g of fresh sepiolitic clay.

Preferably the selected tracer compound(s) is resistant to laundering by chemical treatment with an acid or a base. In preferred embodiments, at least 50% (more preferably at least 75%) of the tracer compound is retained in the hydrocarbon liquid after a sample of the liquid containing 1 mg/l of the tracer compound has been vigorously agitated in contact with an equal volume of 5% aqueous hydrochloric acid. More preferably, at least 50% (more preferably at least 75%) of the tracer compound is retained in the hydrocarbon liquid after a sample of the liquid containing 1 mg/l of the tracer compound has been vigorously agitated in contact with 5% of the sample volume of concentrated hydrochloric acid Preferably at least 50% (more preferably at least 75%) of the tracer compound is retained in the hydrocarbon liquid after a sample of the liquid containing 1 mg/l of the tracer compound has been vigorously agitated in contact with an equal volume of 5% aqueous sulphuric acid. More preferably, at least 50% (more preferably at least 75%) of the tracer compound is retained in the hydrocarbon liquid after a sample of the liquid containing 1 mg/l of the tracer compound has been vigorously agitated in contact with 5% of the sample volume of concentrated sulphuric acid Preferably at least 50% (more preferably at least 75%) of the tracer compound is retained in the hydrocarbon liquid after a sample of the liquid containing 1 mg/l of the tracer compound has been vigorously agitated in contact with an equal volume of 5% aqueous nitric acid. More preferably, at least 50% (more preferably at least 75%) of the tracer compound is retained in the hydrocarbon liquid after a sample of the liquid containing 1 mg/l of the tracer compound has been vigorously agitated in contact with 5% of the sample volume of concentrated nitric acid.

Preferably at least 50% (more preferably at least 75%) of the tracer compound is retained in the hydrocarbon liquid after a sample of the liquid containing 1 mg/l of the tracer compound has been vigorously agitated in contact with an equal volume of 2M aqueous NaOH.

Preferably at least 50% of the tracer compound is retained in the hydrocarbon liquid after a sample of the liquid containing from 50 to 1000 μg/l of the tracer compound has been vigorously agitated in contact with an equal volume of 10% aqueous NaOCl solution.

EXAMPLES

In the Examples, the test methods which are used are described below. The tests were undertaken to determine how much of the tracer compounds was removed from liquid fuels by contact with either a solid absorbent or a liquid chemical. The liquid fuels used were (i) a commercial UK diesel fuel, (ii) a commercial UK 95 gasoline and (iii) a synthetic test fuel, made by mixing together 76% iso-octane, 16% toluene, 5% t-butyl methylether and 3% ethanol (all vol/vol).

Detection of Tracers in Fuels by Fluorescence Spectrometry

Samples were analysed using a Jobin Yvon SPEX Fluoro-Max-3 fluorimeter. A small quantity of each sample (3 ml) was poured into a quartz glass cuvette and irradiated with excitation light appropriate to the molecule under test. Excitation and emission slit widths of 2 nm were used. An emission acquisition spectrum was collected for each molecule and the fluorescent emission at the wavelength showing maximal emission was recorded.

The magnitude of the fluorescent emission of the tracer molecules is proportional to their concentration up to and above 1 mg/L for the molecules under test. This means that tracer concentration may be ascertained by reference to the fluorescent response of a known concentration of the tracer. In practice, the known tracer concentration is the starting concentration of tracer in the hydrocarbon under test. An initial fluorescence spectrum of the tracer is collected, the liquid is subjected to some form of tracer removal treatment and then the fluorescence spectrum of the tracer is re-measured. The ratio of the fluorescent emission after treatment to the emission before treatment is the same as the ratio of tracer concentration after treatment to that before treatment. The ratio of tracer after treatment to beforehand is simply denoted as percentage tracer remaining.

In some examples, the concentration of tracer after treatment is apparently more than before treatment. This is a result of the background fluorescence of the medium being altered by the tracer removal treatment. It may be difficult to compensate for this change in the background fluorescence, which in turn might lead to an apparent increase in tracer fluorescence, and by implication, tracer concentration.

Test for Resistance to Removal by a Solid Adsorbant (Charcoal or Sepiolitic Clay)

The adsorbents used were:

Charcoal:—Activated charcoal (decolourising) from Sigma Aldrich (product number 161551), Sepiolitic clay: a pure fine sepiolite clay from RS Minerals.

10 ml of liquid fuel marked with the test tracer compound at the concentration indicated was shaken vigorously for 1 minute with 0.5 g of the adsorbent. The mixture was allowed to stand for 1 minute and then shaken for a further minute before being filtered to remove the adsorbent. A sample of the fuel was analysed by fluorescence spectrometry and the percentage of the tracer remaining in the treated fuel is shown in Tables 1-4.

Test for Resistance to Removal by Liquid Chemical Treatment 10 ml of liquid fuel marked with the test tracer compound at the concentration indicated was shaken vigorously for 1 minute with a volume of a chemical agent as shown in Tables 1-4. The mixture was allowed to stand for 1 minute and then shaken for a further minute before being left to separate in two layers. A sample of the fuel was analysed by fluorescence spectrometry and the percentage of the tracer remaining in the treated fuel is shown in Tables 1-4.

The tracer compounds used were:

| | | | Fluorescence spectrometry conditions | |
|---|---|---|---|---|
| | | | Exc (nm) | Em (nm) |
| (a) | 8-(4-tert-butylphenyl)-1,3,5,7-tetramethyl-2,6-diethyl difluoroborondipyrromethene, | 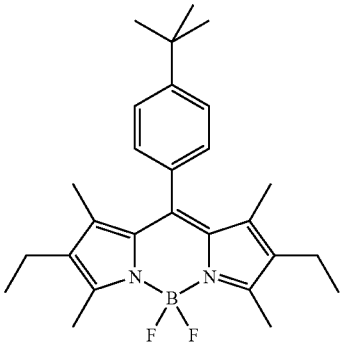 | 515 | 540 |
| (b) | 8-(3,5-bis(trifluoromethyl)phenyl)-1,3,5,7-tetramethyl-2,6-diethyl difluoroborondipyrromethene, | 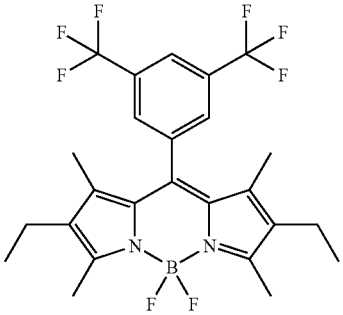 | 530 | 545 |

-continued

| | | | Fluorescence spectrometry conditions | |
|---|---|---|---|---|
| | | | Exc (nm) | Em (nm) |
| (c) | 8-(3,5-bis(trifluoromethyl)phenyl)-1,3,5,7-tetramethyl-2,6-diethyl fluoro-3,5-bis(trifluoromethyl)phenyl-borondipyrromethene | 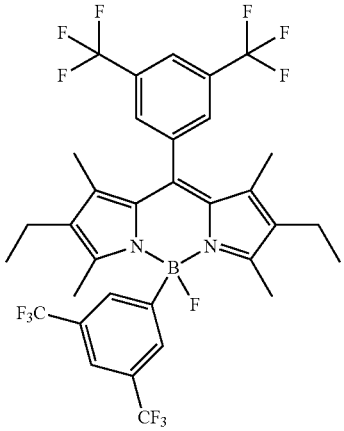 | 530 | 545 |
| (d) | 8-(3,5-bis(trifluoromethyl)phenyl)-1,3,5,7-tetramethyl-difluoroborondipyrromethene, | 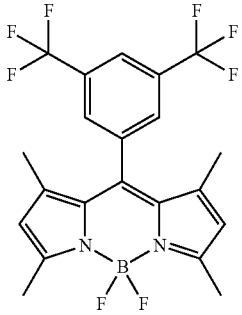 | 505 | 520 |
| (e) | 1,3,5,7,8-pentamethyl-2,6-diethyl fluoro-perfluorophenyl-borondipyrromethene, | 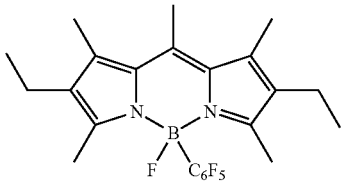 | 515 | 540 |
| (f) | 8-(t-butyl)-1,3,5,7-tetramethyl-2,6-diethyl fluoro-(3,5-bis(trifluoromethyl)phenyl)-borondipyrromethene, | 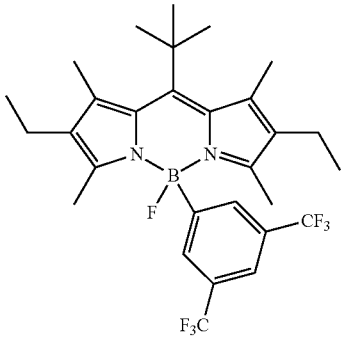 | 515 | 535 |
| (g) | 1,3,5,7,8-pentamethyl-2,6-diethyl difluoroborondipyrromethene. (Comparative Example) | 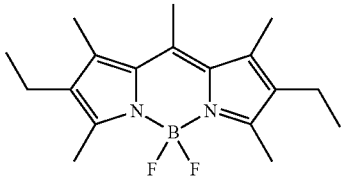 | 515 | 540 |

Example 1

8-(4-tert-butylphenyl)-1,3,5,7-tetramethyl-2,6-diethyl difluoroborondipyrromethene The preparation of 8-(4-tert-butylphenyl)-1,3,5,7-tetramethyl-2,6-diethyl difluoroborondipyrro methene was based on the procedure given in T. Chen, J. H. Boyer, M. L. Trudell, US Army Research Office, Grant DAAH04-95-1-0078 'Synthesis of 2,6-diethyl-3-methacroyloxymethyl-1,5,7,8-tetramethylpyrromethene-BF2 for the preparation of new solid state laser dyes.'

4-tert-butylbenzoyl chloride (0.675 ml, 3.71 mmol) was added to a solution of 3-ethyl-2,4-dimethylpyrrole (1.0 ml, 7.41 mmol) in dichloromethane (25 ml) under nitrogen. The reaction mixture was then heated at 40° C. and monitored by TLC analysis ($SiO_2$ plate, DCM:methanol (19:1) eluent). After 16 hours, the reaction mixture showed complete conversion of the 3-ethyl-2,4-dimethylpyrrole and formation of two new components. By TLC, one weak orange spot was believed to be the half-formed product and a pink spot believed to be the desired dipyrromethene product. The reaction mixture was allowed to cool to room temperature and the solvent removed to afford a red solid. The solid was dissolved in toluene (25 ml) under nitrogen before addition of triethylamine (7.6 ml, 54.5 mmol) and the mixture stirred at room temperature for 20 minutes. Boron trifluoride diethyletherate (1.8 ml, 14.3 mmol) was added to the mixture and heated at reflux for 5 hrs. After 5 hours TLC analysis ($SiO_2$ plate, DCM eluent) showed three new product peaks with large relative front ($R_f$) values and a small spot corresponding to the dipyrromethene. The solution was heated at reflux overnight, after which time TLC analysis showed no change to the reaction mixture from 5 hrs reaction time and so the solution was allowed to cool to room temperature. The mixture was washed with water (3×30 ml), dried over magnesium sulfate and concentrated at reduced pressure to give a purple solid (1.9 g). The solid was purified by column chromatography [silica (64 g), eluting with neat cyclohexane rising to 40% dichloromethane:60% cyclohexane] to afford the product (8-(4-tert-butylphenyl)-1,3,5,7-tetramethyl-2,6-diethyl difluoroborondipyrromethene, compound (a), as a purple solid (0.20 g).

Samples of compound (a) were mixed with samples of hydrocarbon fuels to provide a liquid fuel composition containing the concentration shown in Table 1. The fuel compositions were then subjected to the laundering tests described above. The amount of tracer in the fuel composition was measured before and after each laundering test using the fluorescence spectroscopy method described above. The excitation wavelength was 515 nm and the emission wavelength measured was 540 nm. The concentration of the tracer compound measured in the fuel after the laundering treatment is shown in Table 1 as a % of the measured concentration before the laundering test.

Example 2

8-(3,5-bis(trifluoromethyl)phenyl)-1,3,5,7-tetramethyl-2,6-diethyl difluoroboron dipyrromethene 3,5-bis(trifluoromethyl)benzoyl chloride (0.673 ml, 3.71 mmol) was added to a solution of 3-ethyl-2,4,-dimethylpyrrole (1.0 ml, 7.41 mmol) in dichloromethane (25 ml) under nitrogen. The reaction mixture was then stirred at room temperature and the reaction monitored by TLC analysis ($SiO_2$ plate, DCM:methanol (19:1) eluent). After 16 hours, the reaction mixture showed complete conversion of the 3-ethyl-2,4-dimethylpyrrole and a new pink spot believed to be the desired dipyrromethene product. The solvent was removed to afford a red solid. The solid was dissolved in toluene (25 ml) under nitrogen before addition of triethylamine (6.0 ml, 43.0 mmol) and the mixture stirred at room temperature for 5 minutes. Boron trifluoride diethyletherate (2.5 ml, 20.3 mmol) was added to the mixture and heated at reflux. After 1.5 hours TLC analysis ($SiO_2$ plate, DCM eluent) showed three new product peaks with high $R_f$ values and a small spot with a low $R_f$ corresponding to unreacted dipyrromethene, hence additional boron trifluoride diethyletherate (1.0 ml, 8.1 mmol) was added to the mixture. After five hours at reflux, TLC analysis showed no spot for the dipyrromethene and so the solution was allowed to cool to room temperature. The mixture was washed with water (3×30 ml), dried over magnesium sulfate and concentrated at reduced pressure to give a purple solid (4.5 g). The solid was purified by column chromatography [silica (64 g), eluting with neat cyclohexane rising to 5% dichloromethane:95% cyclohexane] to afford the product 8-(3,5-bis(trifluoromethyl)phenyl)-1,3,5,7-tetramethyl-2,6-diethyl difluoroboron dipyrromethene, compound (b), as a purple solid (1.3 g).

Samples of compound (b) were mixed with samples of hydrocarbon fuels to give a concentration of 1 mg/l. The fuel compositions were then subjected to the laundering tests described above. The amount of tracer in the fuel composition was measured before and after each laundering test using the fluorescence spectroscopy method described above. The excitation wavelength was 530 nm and the emission wavelength measured was 545 nm. The concentration of the tracer compound measured in the fuel after the laundering treatment is shown in Table 2 as a % of the measured concentration before the laundering test.

TABLE 1

| | | | Removal test | | | | | |
|---|---|---|---|---|---|---|---|---|
| Tracer cmpd | Conc (mg/l) | Fuel | Charcoal | Sepiolitic clay | 5% HCl (1:1) | 8% NaOH (1:1) | 11.2% KOH (1:1) | Conc. $H_2SO_4$ (1:19) |
| a | 1 | iii | 58 | 98 | 99 | 99(8%) | | 1 |
| a | 1 | ii | 91 | 100 | 105 | | 102 | 57 |
| a | 1 | i | 95 | 95 | 104 | | 115 | 3 |
| a | 0.05 | ii | 79 | 104 | 108 | | 110 | 69 |

TABLE 2

| Tracer cmpd | Fuel | Removal agents: Charcoal | Sepiolitic clay | 10% NaOH (1:1) | 30% NaOH (1:1) | 5% HCl (1:1) | 5% $H_2SO_4$ (1:1) | Conc. $H_2SO_4$ (1:19) | Conc. $HNO_3$ (1:19) | 5% $HNO_3$ (1:1) |
|---|---|---|---|---|---|---|---|---|---|---|
| b | iii | 90 | 97 | | 98 | | | 95 | 95 | |
| b | ii | 100 | 101 | | 103 | | | 97 | 85 | |
| b | i | 99 | | 96 | | 102 | 98 | 2 | 2 | 100 |

Example 3

8-(3,5-bis(trifluoromethyl)phenyl)-1,3,5,7-tetramethyl-2,6-diethyl fluoro-3,5-bis(trifluoromethyl)phenyl-borondipyrromethene A solution of 8-(3,5-bis(trifluoromethyl)phenyl)-1,3,5,7-tetramethyl-2,6-diethyl difluoroboron dipyrromethene (0.1 g, 0.19 mmol) in THF (5 ml) was added to a large excess of 3,5-bis(trifluoromethyl)phenylmagnesium bromide in THF (0.95M solution, 3 ml). The mixture was stirred at room temperature under nitrogen for 3 days. TLC analysis ($SiO_2$ plate, cyclohexane:ethyl acetate (9:1) eluent) showed starting material remained and two new fluorescent spots; one with an $R_f$=0.9 and one with $R_f$=0.1. The reaction was quenched with water, the organic layer separated and dried over magnesium sulphate then concentrated under reduced pressure to afford a purple oily solid. The solid was purified by column chromatography (silica gel, cyclohexane:ethyl acetate (9:1) eluent) to isolate the compound (c).

Samples of compound (c) were mixed with samples of hydrocarbon fuels to give a concentration of 1 mg/l. The resulting fuel compositions were then subjected to the laundering tests described above. The amount of tracer in the fuel composition was measured before and after each laundering test using the fluorescence spectroscopy method described above. The excitation wavelength was 530 nm and the emission wavelength measured was 545 nm. The concentration of the tracer compound measured in the fuel after the laundering treatment is shown in the Table 3 as a % of the measured concentration before the laundering test.

TABLE 3

| Tracer cmpd | Fuel | Removal agents: Charcoal | Sepiolitic clay | 30% NaOH (1:1) | 10% NaOH (1:1) | Conc. $H_2SO_4$ (1:19) | 10% NaOCl (1:1) | Conc. $HNO_3$ (1:19) | 5% HCl (1:1) |
|---|---|---|---|---|---|---|---|---|---|
| c | iii | 101 | 104 | 102 | | 130 | 102 | | |
| c | ii | 101 | 103 | | 107 | 128 | | 100 | 107 |

Example 4

Samples of compounds (d)-(h) were mixed with samples of hydrocarbon fuels to provide a liquid fuel composition containing the concentrations shown in the Table 4. The fuel compositions were subjected to the laundering tests described above. The amount of tracer in the fuel composition was measured before and after each laundering test using the fluorescence spectroscopy method described above. The excitation wavelength and emission wavelength for each tracer is shown in Table 1. The concentration of the tracer compound measured in the fuel after the laundering treatment is shown in Table 4 as a % of the measured concentration before the laundering test.

TABLE 4

| Tracer compound | Conc (mg/l) | Fuel | Removal test: Charcoal | Sepiolitic clay | 10% NaOH (1:1) | 20% NaOH (1:1) | Conc. $H_2SO_4$ (1:19) | 5% $H_2SO_4$ (1:1) | 12% HCl (1:1) | 10% NaOCl (1:1) | Conc. $HNO_3$ (1:19) | 5% $HNO_3$ (1:1) |
|---|---|---|---|---|---|---|---|---|---|---|---|---|
| d | 1 | iii | 85 | 98 | | 102 | 77 | 102 | | | 97 | 102 |
| d | 0.1 | iii | 73 | | | | 69 | | | | 97 | |
| d | 0.01 | iii | 78 | | | | 64 | | | | 102 | |
| d | 1 | ii | 100 | 102 | | 103 | 96 | 103 | | | 98 | 102 |
| e | 1 | iii | 21 | 100 | 101 | | 73 | 101 | 100 | 99 | 14 | 13 |
| e | 1 | ii | 48 | 101 | 104 | | 79 | 104 | 103 | 103 | 91 | 105 |
| e | 1 | i | 79 | 108 | | | 8 | | | | 5 | |
| f | 1 | iii | 46 | 103 | 101 | | 77 | 101 | 100 | | 21 | 101 |
| f | 1 | ii | 61 | 97 | 104 | | 81 | 105 | 101 | | 70 | 102 |

TABLE 4-continued

| Tracer compound | Conc (mg/l) | Fuel | Removal test | | | | | | | | | |
|---|---|---|---|---|---|---|---|---|---|---|---|---|
| | | | Charcoal | Sepiolitic clay | 10% NaOH (1:1) | 20% NaOH (1:1) | Conc. $H_2SO_4$ (1:19) | 5% $H_2SO_4$ (1:1) | 12% HCl (1:1) | 10% NaOCl (1:1) | Conc. $HNO_3$ (1:19) | 5% $HNO_3$ (1:1) |
| g* | 1 | iii | 8 | 100 | 101 | | 0.3 | 102 | 102 | 101 | 56 | 92 |
| g* | 1 | ii | 27 | 99 | 101 | | 14 | 104 | 97 | 78 | 103 | |
| g* | 1 | i | 32 | 82 | | | 3 | | | | 2 | |

*g is a comparative example.

The invention claimed is:

1. A method of marking a hydrocarbon liquid comprising the step of adding to said liquid, as a tracer compound, a compound of Formula I:

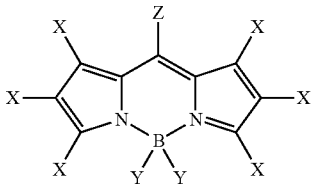

wherein, each X is independently selected from the group consisting of a hydrogen atom, a bromine atom, a fluorine atom, a partially or fully halogenated alkyl group, a linear, branched or cyclic $C_1$-$_{C20}$ alkyl group and a phenyl group substituted with one or more halogen atoms, an alkyl group or a halogenated alkyl group;

each Y is independently selected from the group consisting of a bromine atom, a fluorine atom, a partially or fully halogenated alkyl group, a branched or cyclic $C_1$-$C_9$ alkyl group and a phenyl group substituted with at least one alkyl group and/or a halogenated alkyl group;

Z is selected from the group consisting of (i) a phenyl group substituted with one or more halogen atoms, an aliphatic group or a halogenated aliphatic group, (ii) a partially or fully halogenated alkyl group or (iii) a linear, branched or cyclic $C_1$-$C_{20}$ alkyl group with the proviso that when each Y is a fluorine atom, Z is not a linear or branched $C_1$-$C_{20}$ alkyl group.

2. A method according to claim 1, wherein at least 50% of the tracer compound is retained in the hydrocarbon liquid after a 10 ml sample of the liquid containing from 50 to 1000 μg/1 of the tracer compound has been shaken for 2 minutes with 0.5g of fresh activated charcoal.

3. A method according to claim 1, wherein at least 50% of the tracer compound is retained in the hydrocarbon liquid after a 10 ml sample of the liquid containing from 50 to 1000 μg/1 of the tracer compound has been shaken for 2 minutes with 0.5g of fresh powdered sepiolitic clay.

4. A method according to claim 1, wherein at least 50% of the tracer compound is retained in the hydrocarbon liquid after a sample of the liquid containing from 50 to 1000 μg/1 of the tracer compound has been vigorously agitated in contact with an equal volume of up to 5% aqueous HCl.

5. A method according to claim 1, wherein at least 50% of the tracer compound is retained in the hydrocarbon liquid after a sample of the liquid containing from 50 to 1000 μg/1 of the tracer compound has been vigorously agitated in contact with an equal volume of up to 5% aqueous $H_2SO_4$.

6. A method according to claim 1, wherein at least 50% of the tracer compound is retained in the hydrocarbon liquid after a sample of the liquid containing from 50 to 1000 μg/1 of the tracer compound has been vigorously agitated in contact with an equal volume of up to 5% aqueous $HNO_3$.

7. A method according to claim 1, wherein at least 50% of the tracer compound is retained in the hydrocarbon liquid after a sample of the liquid containing from 50 to 1000 μg/1 of the tracer compound has been vigorously agitated in contact with 2 Molar aqueous sodium or potassium hydroxide solution.

8. A method according to claim 1, wherein at least 50% of the tracer compound is retained in the hydrocarbon liquid after a sample of the liquid containing from 50 to 1000 μg/1 of the tracer compound has been vigorously agitated in contact with an equal volume of 10% aqueous NaOC1 solution.

9. A method according to claim 1, wherein each X is independently selected from the group consisting of hydrogen and a $C_1$-$C_6$ alkyl group.

10. A method according to claim 1, wherein each Y is independently selected from the group consisting of a fluorine atom and a substituted phenyl group, the substituents being selected from at least one of a fluorine atom and a fluorinated alkyl group.

11. A method according to claim 1, wherein Z consists of a phenyl group substituted with at least one alkyl group or halogenated alkyl group.

12. A method according to claim 1, wherein the tracer compound is selected from the group consisting of:

(i) 8-(4-tert-butylphenyl)-1,3,5,7-tetramethyl-2,6-diethyl difluoroborondipyrromethene, (ii) 8-(3,5-bis(trifluoromethyl)phenyl)-1,3,5,7-tetramethyl-2,6-diethyl difluoroborondipyrromethene, (iii) 8-(3,5-bis(trifluoromethyl)phenyl)-1,3,5,7-tetramethyl-2,6-diethyl fluoro-(3,5-bis(trifluoromethyl))phenyl-borondipyrromethene (iv) 8-(3,5-bis(trifluoromethyl)phenyl)-1,3,5,7-tetramethyl-difluoroborondipyrromethene, (v) 1,3,5,7,8-pentamethyl-2,6-diethyl fluoro -perfluorophenyl-borondipyrromethene, (vi) 8-(t-butyl)-1,3,5,7-tetramethyl-2,6-diethyl fluoro -(3,5-bis(trifluoromethyl)phenyl)-borondipyrromethene, (vii) 8-(3,5-bis(trifluoromethyl)phenyl)-1,3,5,7-tetramethyl-2,6-diethyl bis(3,5-bis(trifluoromethyl)phenyl)-borondipyrromethene viii) 8-(perfluoropropyl)-1,3,5,7-tetramethyl-2,6-diethyl difluoroborondipyrromethene.

13. A method according to claim 1, wherein the hydrocarbon liquid contains more than one tracer compound.

14. A method according to claim 1, wherein the hydrocarbon liquid comprises a diesel fuel, a gasoline fuel or a solvent.

15. A method according to claim 1, wherein the tracer compound is added to the hydrocarbon liquid in the form of a concentrated dosing solution of the tracer compound in a solvent.

16. A liquid composition comprising a mixture of a hydrocarbon liquid and a tracer compound, wherein said tracer compound comprises a compound of Formula I:

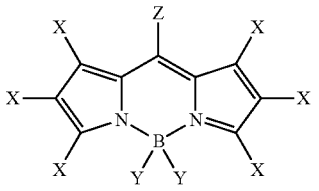

wherein, each X is independently selected from the group consisting of a hydrogen atom, a bromine atom, a fluorine atom, a partially or fully halogenated alkyl group, a linear, branched or cyclic $C_1$-$C_{20}$ alkyl group and a phenyl group substituted with one or more halogen atoms, an alkyl group or a halogenated alkyl group;

each Y is independently selected from the group consisting of a bromine atom, a fluorine atom, a partially or fully halogenated alkyl group, a branched or cyclic $C_1$-$C_9$ alkyl group and a phenyl group substituted with at least one alkyl group and/or a halogenated alkyl group;

Z is selected from the group consisting of (i) a phenyl group substituted with one or more halogen atoms, an aliphatic group or a halogenated aliphatic group, (ii) a partially or fully halogenated alkyl group or (iii) a linear, branched or cyclic $C_1$-$C_{20}$ alkyl group with the proviso that when each Y is a fluorine atom, Z is not a linear or branched $C_1$-$C_{20}$ alkyl group.

17. A liquid composition according to claim 16, wherein each X is independently selected from the group consisting of hydrogen and a $C_1$-$C_6$ alkyl group.

18. A liquid composition according to claim 16, wherein each Y is independently selected from the group consisting of a fluorine atom and a substituted phenyl group, the substituents being selected from at least one of a fluorine atom and a fluorinated alkyl group.

19. A liquid composition according to claim 16, wherein Z consists of a phenyl group substituted with at least one alkyl group or halogenated alkyl group.

20. A liquid composition according to claim 16, wherein the tracer compound is selected from the group consisting of:

(i) 8-(4-tert-butylphenyl)-1,3,5,7-tetramethyl-2,6-diethyl difluoroborondipyrromethene, (ii) 8-(3,5-bis(trifluoromethyl)phenyl)-1,3,5,7-tetramethyl-2,6-diethyl difluoroborondipyrromethene, (iii) 8-(3,5-bis(trifluoromethyl)phenyl)-1,3,5,7-tetramethyl-2,6-diethyl fluoro-(3,5-bis(trifluoromethyl))phenyl-borondipyrromethene (iv) 8-(3,5-bis(trifluoromethyl)phenyl)-1,3,5,7-tetramethyl-difluoroborondipyrromethene, (v) 1,3,5,7,8-pentamethyl-2,6-diethyl fluoro -perfluorophenyl-borondipyrromethene, (vi) 8-(t-butyl)-1,3,5,7-tetramethyl-2,6-diethyl fluoro -(3,5-bis(trifluoromethyl)phenyl)-borondipyrromethene, (vii) 8-(3,5-bis(trifluoromethyl)phenyl)-1,3,5,7-tetramethyl-2,6-diethyl bis(3,5-bis(trifluoromethyl)phenyl)-borondipyrromethene viii) 8-(perfluoropropyl)-1,3,5,7-tetramethyl-2,6-diethyl difluoroborondipyrromethene.

21. A liquid composition according to claim 16, which contains more than one tracer compound.

22. A liquid composition according to claim 16, wherein the hydrocarbon liquid comprises a diesel fuel, a gasoline fuel or a solvent.

23. A liquid composition according to claim 16, containing from 1 μg/1 to 10 mg/1 of said tracer compound.

* * * * *